US010869563B2

(12) United States Patent
Brenner et al.

(10) Patent No.: US 10,869,563 B2
(45) Date of Patent: Dec. 22, 2020

(54) PRODUCT DISPLAYING HOLDER SYSTEMS

(71) Applicant: iSee Store Innovations, L.L.C., St. Louis, MO (US)

(72) Inventors: Steven Allen Brenner, Richmond Heights, MO (US); Mark Schaefer, Town & Country, MO (US); Sesha Madireddi, St. Charles, MO (US); Rushil Eaga, St. Louis, MO (US)

(73) Assignee: iSee Store Innovations, L.L.C., St. Louis, MO (US)

( * ) Notice: Subject to any disclaimer, the term of this patent is extended or adjusted under 35 U.S.C. 154(b) by 8 days.

(21) Appl. No.: 16/567,285

(22) Filed: Sep. 11, 2019

(65) Prior Publication Data

US 2020/0093286 A1 Mar. 26, 2020

Related U.S. Application Data

(60) Provisional application No. 62/734,368, filed on Sep. 21, 2018.

(51) Int. Cl.

| | |
|---|---|
| ***A47F 5/08*** | (2006.01) |
| ***A47F 5/00*** | (2006.01) |
| ***G09F 23/00*** | (2006.01) |
| *A47B 73/00* | (2006.01) |
| *A47B 57/06* | (2006.01) |
| *A47B 47/00* | (2006.01) |

(52) U.S. Cl.

CPC ..... *A47F 5/0807* (2013.01); *A47F 5/0006* (2013.01); *G09F 23/00* (2013.01); *A47B 47/00* (2013.01); *A47B 57/06* (2013.01); *A47B 73/00* (2013.01); *A47F 5/08* (2013.01); *A47F 5/0823* (2013.01)

(58) Field of Classification Search

CPC .... A47F 5/0807; A47F 5/0006; A47F 5/0823; A47F 5/08; G09F 23/00; G09F 23/0058; A47B 73/00; A47B 57/06; A47B 47/00

USPC ..... 211/74, 75, 113, 117, 118

See application file for complete search history.

(56) References Cited

U.S. PATENT DOCUMENTS 672,417 A * 4/1901 Field ..... B65F 1/141 220/481

776,332 A * 11/1904 Kloeppinger ..... A47F 7/283 211/75

(Continued)

*Primary Examiner* — Jonathan Liu
*Assistant Examiner* — Devin K Barnett
(74) *Attorney, Agent, or Firm* — The Small Patent Law Group LLC; Joseph M. Butscher

(57) ABSTRACT

A product displaying holder system is configured to be removably coupled to a surface of a component. The product displaying holder system includes a retaining bracket having a longitudinal main beam and one or more securing mounts. Holder channels are formed through the longitudinal main beam. One or more product holders are removably coupled to the retaining bracket. Each product holder includes a bracket-mating stud that is retained within one of holder channels. The holder channels allow the product holder(s) to be selectively positioned at different locations along the main beam. One or more securing assemblies are coupled to the securing mount(s). The securing assemblies are configured to securely couple the product displaying holder system to the surface of the component. In at least one embodiment, the securing mount(s) are perpendicular to the main beam.

20 Claims, 9 Drawing Sheets

(56) References Cited

U.S. PATENT DOCUMENTS 1,017,102 A * 2/1912 Kaufman ..... 248/313
1,159,813 A * 11/1915 Volkhardt ..... A47G 25/0685 211/104
1,325,143 A * 12/1919 Conterio ..... F16M 13/025 108/42
1,739,801 A * 12/1929 Pitts ..... A47F 7/147 220/483
3,408,665 A * 11/1968 Harris ..... F16B 12/60 5/304
4,304,382 A * 12/1981 Jelen ..... B25H 3/04 211/89.01
4,984,693 A * 1/1991 Belokin, Jr. ..... A47B 96/16 211/88.01
5,188,325 A * 2/1993 Hilty ..... A47F 7/06 211/30
5,351,841 A * 10/1994 Belokin ..... A47F 5/08 211/88.01
5,358,128 A * 10/1994 Belokin ..... A47B 73/008 211/75
5,547,088 A * 8/1996 Belokin ..... A47B 96/06 211/103
5,579,928 A * 12/1996 Anukwuem ..... B01L 9/06 206/443
5,655,673 A * 8/1997 Weterrings ..... A47B 81/00 211/74
D406,715 S * 3/1999 Badillo ..... D6/524
5,921,403 A * 7/1999 Coffaro ..... A47F 7/06 211/30
5,924,579 A * 7/1999 Dupont ..... A45D 44/02 211/106
5,974,849 A * 11/1999 Dixon ..... B21D 5/08 72/179
6,422,400 B1 * 7/2002 Miller ..... A47F 7/06 211/183
6,431,386 B1 * 8/2002 Hofman ..... A47K 3/281 220/481
6,532,704 B2 * 3/2003 Hart ..... E06B 9/02 248/220.1
6,899,236 B2 * 5/2005 Yang ..... A47B 81/00 211/71.01
7,017,759 B1 * 3/2006 Friend ..... A47B 73/00 211/75
7,028,962 B1 * 4/2006 Hostetler ..... B63B 17/00 211/75
D637,457 S * 5/2011 Thompson ..... D7/600.1
8,100,372 B2 * 1/2012 Vlies ..... F16M 11/10 248/220.1
8,573,553 B2 * 11/2013 Stephan ..... B60N 3/102 248/311.2
D719,279 S * 12/2014 Hoskinson ..... D25/55
9,648,993 B2 * 5/2017 Gainey ..... A47K 10/04
10,315,321 B2 * 6/2019 Frierson ..... A45D 27/29
D855,408 S * 8/2019 Tsai ..... D7/600.1
2003/0160060 A1 * 8/2003 Hornblad ..... A47F 5/08 221/256
2006/0043036 A1 * 3/2006 Robertson ..... F16B 12/00 211/75
2006/0065612 A1 * 3/2006 Gonneville ..... A47B 73/004 211/75
2007/0152120 A1 * 7/2007 Hostetler ..... B63C 11/22 248/206.3
2008/0224004 A1 * 9/2008 Gallien ..... A47B 96/066 248/220.1
2012/0102641 A1 * 5/2012 Srour ..... A47D 7/03 5/93.1
2012/0187264 A1 * 7/2012 Vlies ..... F16M 11/10 248/220.1
2015/0201750 A1 * 7/2015 Hopkins ..... A47B 43/003 211/75
2015/0240991 A1 * 8/2015 Gallo ..... F16M 13/02 248/220.1
2015/0250333 A1 * 9/2015 Schaefer ..... A47B 73/008 211/89.01
2020/0093285 A1 * 3/2020 Brenner ..... A47F 5/005
2020/0109731 A1 * 4/2020 Hall ..... F16C 11/04

* cited by examiner

PRODUCT DISPLAYING HOLDER SYSTEMS

RELATED APPLICATIONS

This application relates to and claims priority benefits from U.S. Provisional Patent Application No. 62/734,368 entitled "Product Displaying Holder Systems" filed Sep. 21, 2018, which is hereby incorporated by reference in its entirety.

FIELD OF EMBODIMENTS OF THE DISCLOSURE

Embodiments of the present disclosure generally relate to product displaying holder systems, such as may be used to reliably hold, secure, and display beverage containers in a variety of positions or orientations within a refrigerated cooler, for example.

BACKGROUND OF THE DISCLOSURE

Various commercial enterprises offer goods for sale that may be contained within a transparent container. For example, various convenience stores offer refreshments for sale. Some of the refreshments, such as soft drinks, alcoholic beverages, and the like, are refrigerated. Often, the refreshments are contained within a refrigerated compartment having a transparent door (formed of, for example, glass). The transparent door allows a customer to see the types of soft drinks that are available for sale. If the customer chooses to purchase a particular soft drink, the customer opens the door, removes a soft drink within the refrigerated compartment, and then closes the door.

The space within a refrigerated compartment is limited. As such, each refrigerated compartment is able to contain a limited number of products. A known refrigerated compartment includes multiple shelves on which various products are positioned. When the shelf space is fully occupied by product, additional products are not able to be positioned within the refrigerated compartment. Instead, as products within the refrigerated compartment are removed by customers, additional product may then be moved into the open space on the shelf.

As can be appreciated, the additional product that is not within the refrigerated compartment is stored at other areas of an establishment, thereby taking up valuable space. Further, if a large number of products are removed from the refrigerated compartment, the additional products that are used to replenish the refrigerated compartment take time to cool to a desirable temperature.

SUMMARY OF THE DISCLOSURE

A need exists for a system and method of accommodating and displaying increased numbers of products within a display container, such as a refrigerated compartment.

With that need in mind, certain embodiments of the present disclosure provide a product displaying holder system that is configured to be removably coupled to a surface of a component. The product displaying holder system includes a retaining bracket having a main beam and one or more securing mounts. A plurality of holder channels are formed through the main beam. One or more product holders are removably coupled to the retaining bracket. Each product holder includes a bracket-mating stud that is retained within one holder channel. The holder channels allow the product holders to be selectively positioned at different locations along the main beam. One or more securing assemblies are coupled to the securing mount(s). The securing assemblies are configured to securely couple the product displaying holder system to the surface of the component.

Optionally, the plurality of holder channels may be longitudinally aligned along a common longitudinal axis. In at least one embodiment, the securing mount(s) are perpendicular to the main beam. In another aspect, a bracing support ridge may be connected to the securing mount(s). Optionally, each securing assembly may include a suction cup coupled to a suction securing nut. In another aspect, the main beam may be configured to be positioned proximate to a hinge of a door. In another example, an insert having one or more of text or graphics may be removably coupled to the main beam.

In one or more embodiments, a product displaying holder system that is configured to be removably coupled to a surface of a component is provided. The product displaying holder system includes a retaining bracket having a main beam including a main body and a flange extending from the main body. The main body has a plurality of holder channels formed therethrough. One or more securing mounts are secured to the flange of the main beam, and at least one of the one or more securing mounts including a flat panel are configured to receive and display advertising material. One or more securing assemblies are coupled to the one or more securing mounts, wherein the one or more securing assemblies are configured to securely couple the product displaying holder system to the surface of the component.

Optionally, the flat panel extends from a first end to a second end that includes an opening for receiving a securing assembly of the one or more securing assemblies. In another aspect, flat panel includes a first section at the first end and a second section that includes the opening for receiving the securing assembly, and the second section extends past the first section. In yet another aspect, the second section includes at least on arcuate surface. Alternatively, the flat panel includes a uniform width. Optionally, the one or more securing mounts are welded to the flange of the main beam. In another aspect, the one or more securing mounts are perpendicular to the main body of the main beam. In one example, each of the one or more securing assemblies comprises a suction cup coupled to a suction securing nut. In another example, the main beam is configured to be positioned proximate to a hinge of a door. Optionally, the product displaying holder system also includes an insert that has one or more of text or graphics removably coupled to the main beam.

In one or more embodiments a method of manufacturing a product displaying holder system is provided that includes forming a retaining bracket having a main beam including a main body and a flange extending from the main body. The main body has a plurality of holder channels formed therethrough. Also provided is selecting one or more securing mounts including at least one securing mount with a flat panel configured to receive and display advertising material, securing the one or more securing mounts selected to the flange of the main beam, and mechanically coupling securing assembly in each of the one or more securing mounts selected, each securing assembly configured to securely couple the product displaying holder system to the surface of the component.

Optionally, securing the one or more securing mounts selected to the flange of the main beam includes welding each of the securing mounts selected to the flange. In another aspect, also provided is securing an insert including the advertising material to the flat panel.

DETAILED DESCRIPTION OF THE DISCLOSURE

The foregoing summary, as well as the following detailed description of certain embodiments will be better understood when read in conjunction with the appended drawings. As used herein, an element or step recited in the singular and proceeded with the word "a" or "an" should be understood as not excluding plural of the elements or steps, unless such exclusion is explicitly stated. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

Figure 1:
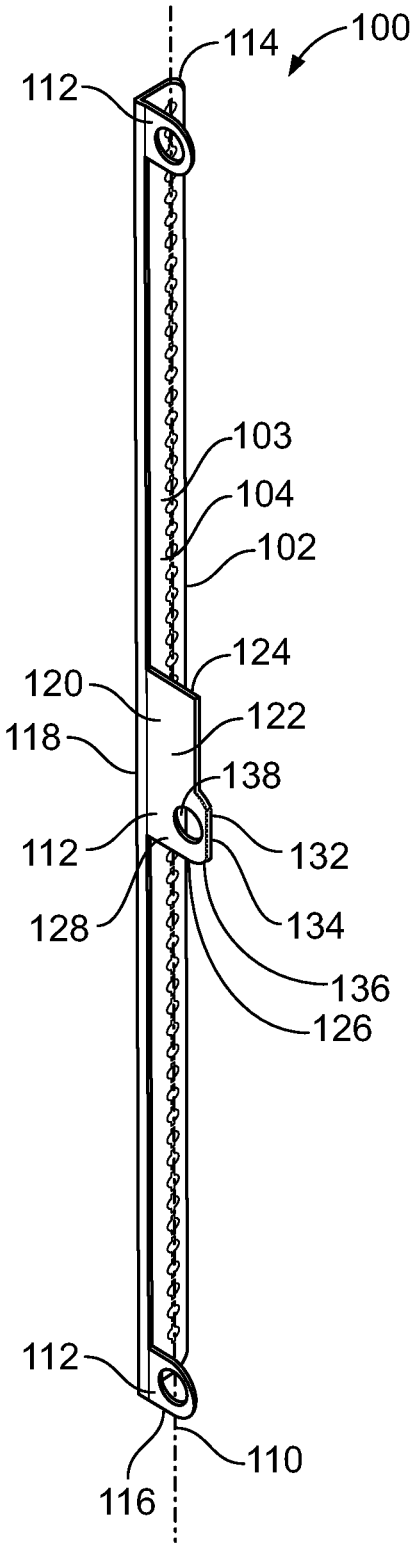
FIG. 1 illustrates a front perspective view of a product displaying holder system, according to an embodiment of the present disclosure.

FIG. 1 illustrates a perspective front view of an example embodiment of a retaining bracket 100, according to an embodiment of the present disclosure. The retaining bracket 100 includes a longitudinal main beam 102 having a main body 103 with a first planar surface 104 and an opposite second planar surface 106. The main beam 102 also includes a flange 107 that extends orthogonal to the main body 103 and in this example is of one-piece construction with the main body 103. In the example embodiment shown, the flange 107 is not as wide as the main body 103, though in other examples, the flange 107 may be the same width or a greater width than the main body 103.

A plurality of holder channels 108 are formed through the main body 103 of the longitudinal main beam 102 between and through the first planar surface 104 and the second planar surface 106. Each holder channel 108 is configured to receive and retain a bracket-mating stud (FIG. 2) of a product holder (FIG. 2), such as described in U.S. patent application Ser. No. 14/623,679, entitled "Systems and Methods for Securing and Displaying Products," filed Feb. 17, 2015, which is hereby incorporated by reference in its entirety. As shown, the holder channels 108 are longitudinally aligned along a common axis 110. The axis 110 may be a central longitudinal axis of the main body 103. Optionally, the axis 110 may be offset from the central longitudinal axis of the main body 103.

The plurality of holder channels 108 allow for one or more product holders to be selectively positioned at different locations along the longitudinal main body 103. In at least one embodiment, the holder channels 108 have a keyed or keyhole shape that is configured to securely lock products to the main beam 102, so that the product holders are unable to rotate. Fastener screws may secure the product holders from the back, and a spacer may be positioned within a gap created by a mounting hole for the fastener on the back of the holder and allow the fastener screw to have sufficient thread engagement and for the head of the screw to lock against it and pull the product holder into a secure and tight engagement with the main body 103.

The retaining bracket 100 also includes one or more securing mounts 112. As shown, the retaining bracket 100 may include a securing mount 112 at a first end 114, a securing mount 112 at a second end 116 that is opposite from the first end 114, and a securing mount 112 between the first end 114 and the second end 116, such as at a central location 118. Optionally, the retaining bracket 100 may include more or less securing mounts 112 than shown. For example, the retaining bracket 100 may include securing mounts 112 only at locations proximate to the first end 114 and the second end 116. In at least one other embodiment, the retaining bracket 100 may include only a single securing mount 112, such as proximate to the first end 114.

Each securing mount 112 may include a flat panel 120. While in the example embodiment of FIG. 1 a flat panel 120 is only illustrated on the central securing mount 112, in other example embodiments a flat panel 120 may be provided on more than one securing mount 112, or each securing mount.

The flat panel 120 may be of size and shape to accommodate different refrigeration devices and door sizes. For example, in the example of FIG. 1 the flat panel 120 includes a first section 122 that is generally rectangular at a first end 124 and extends to a second end 126 that includes a second section 128 that includes a first arcuate surface 132 that extends to a planar surface 134 that extends to a second arcuate surface 136. The first arcuate surface 132, planar surface 134, and second arcuate surface 136 extend away from the flange 107, past the first section 122, and includes an opening 138 for receiving a portion of a securing assembly (for example, a portion of a securing nut), that secures the retaining bracket to a component such as a door as described in U.S. patent application Ser. No. 14/623,679, entitled "Systems and Methods for Securing and Displaying Products," filed Feb. 17, 2015, and/or U.S. patent Ser. No. 16/052,822, entitled "Securing Assembly," filed Aug. 2, 2015, which is also hereby incorporated by reference in its entirety. In one example the securing assembly is a suction cup that is securely retained within the opening 138. While in this example a first arcuate surface 136, planar surface 134, and second arcuate surface 136 are provided, in another example the second section 128 may include an arcuate surface without the planar surface that extends past the first section 122 and includes the opening 138. In yet another example, the flat panel 120 may not have a second section that extends past a first section, and instead includes a flat panel 120 that has a generally uniform width from the first end 124 to the second end 126 and an arcuate surface adjacent the opening 138 therein.

In one example, the flat panel 120 extends longitudinally along the main body 103 and is of size and shape to receive an advertising label. The advertising label may be secured to the flat panel 120 by being within a plastic pocket adhered to the flat panel, through static electricity, adhesive, magnets, or the like to provide and display the advertising label. In the example, when an advertising label is provided, the flat panel 120 extends such that when a securing assembly is secured within the opening 138, the securing assembly does not impede a line of sight of a user aligned with the main body 103.

In one example, the securing mounts 112, including securing mounts 112 that include the flat panel 120, are each manufactured separately from the main beam 102. In one example, each securing mount 112 is spot welded to the main beam 102 of the retaining bracket 100. In particular, the flange 107 is of size and shape to provide a surface for the spot welding of the securing mounts 112 to the main beam 102. In this manner, the retaining bracket 100 as illustrated in FIG. 1 is of four-piece welded construction, with the main body 103 and flange 107 being a primary piece, and each securing mount 112 and accompanying securing assembly 150 (FIGS. 2-3) being other pieces. By having a main beam 102 with a flange 107 for receiving securing mounts 112, the main beam 102 may be repeatedly manufactured, and then depending on the needs of customers, the securing mounts 112 need only be selected, placed, and welded to the main beam to provide the a particular retaining bracket 100.

For example, a customer may desire to have a retaining bracket 100 as illustrated in FIG. 1 that includes three securing mounts 112, one at a first end 124, one at a second end 126, and a third central securing mount 112 that includes a flat panel 120 with a second section 128 that extends past a first section 122 and includes a first arcuate surface 132, a planar surface 134, and a second arcuate surface 136 adjacent the opening 138. Alternatively, a customer may desire to have four securing mounts 112, one at the first end 124, one at the second end 126, and two central securing mounts 112 each having a flat panel 120. These flat panels 120 each may be of the type that includes a uniform width and an arcuate surface adjacent the opening 138. Alternatively, the two central securing mounts 112 could have different flat panels. Regardless of the choice of the customer, the manufacturer need only manufacture the main beam 102, and individual securing mounts 112, and then assemble and secure the individual securing mounts 112 to the main beam as needed by a customer. Consequently, by providing four separate pieces and spot welding them together, manufacturing ease is enhanced, and manufacturing cost is reduced.

Figure 2:
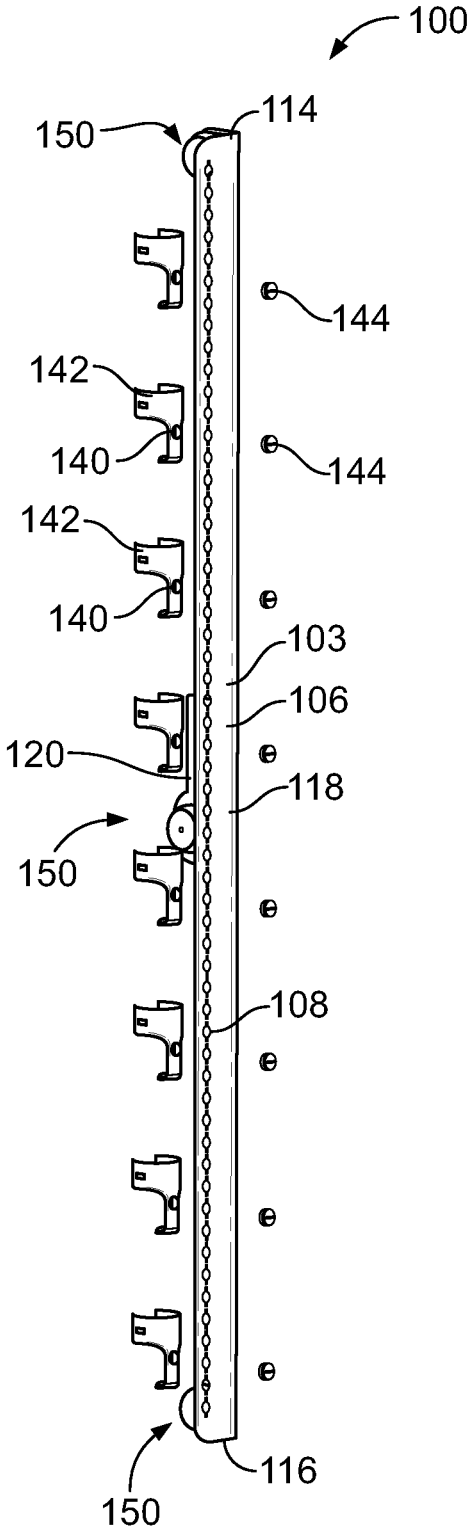
FIG. 2 illustrates a perspective rear exploded view of a product displaying holder system, according to an embodiment of the present disclosure.

FIG. 2 illustrates a back exploded perspective view of the retaining bracket 100. The main beam 102 may include more or less holder channels 108 than shown. Further, a distance between neighboring (that is, closest) holder channels 108 may be greater or less than shown. The holder channels 108 are sized and shaped to receive bracket-mating studs 140 of product holders 142. The bracket-mating studs 140 are received by a retaining element 144 such as a nut to removably and replaceably secure a product holder 142 to the retaining bracket 100. In this manner, a customer may position product holders based on the size and shape of a container of the product.

Figure 3:
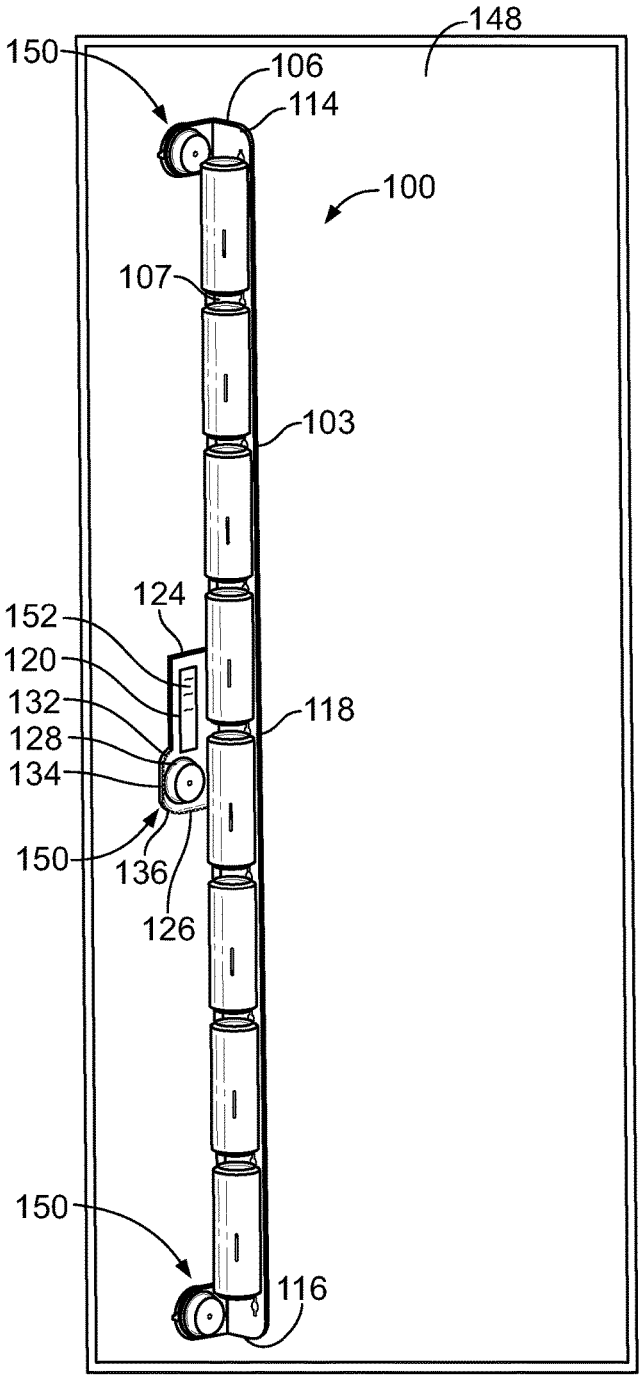
FIG. 3 illustrates a front perspective view of a product displaying holder system, according to an embodiment of the present disclosure.

FIG. 3 illustrates a front perspective view of the retaining bracket 100 holding product 146 and removably secured to a door 148 by a securing assembly 150. In this example the product 146 is plural cans of similar size and shape. In other examples the product may include cans of varying height and/or diameter, boxes, plastic bottles, glass bottles, or the like. To this end, the product holders 142 may be positioned according to the size and shape of the product 146.

The securing assembly 150 in this example includes plural suction cup members that use suction to secure against the door 148. Each suction cup member is secured within a corresponding opening 138 of the securing mounts 112 that have been secured to the main beam 102. Each securing mount 112 is of size and shape to receive a corresponding suction cup member and absorb the shear force created by the product 146. To this end, the securing assembly 150 provides sufficient force to secure the bracket assembly 100 to the door 148 without allowing the shear force created by the product 146 to separate the retaining bracket 100 from the door 148. While suction cups are illustrated in this example, in other examples, the securing assembly may include removable adhesives, brackets that mechanically attach to the door 148 or interior of a freezer, or the like.

In the example of FIG. 3, an insert 152 is provided secured to the flat panel 120. The insert 152 may have one or more of text or graphics removably coupled to the flat panel 120, and thus to the main beam 102. The insert 152 may be coupled to the flat panel 120 by the flat panel including a pocket, adhesive attachment, static electricity, mechanical attachment including using nuts and bolts, or the like. By providing the flat panel 120 as part of a securing mount 112, manufacturing steps are reduced, and space is saved. Thus, the securing mount 112 provides dual functionality.

Figure 4:
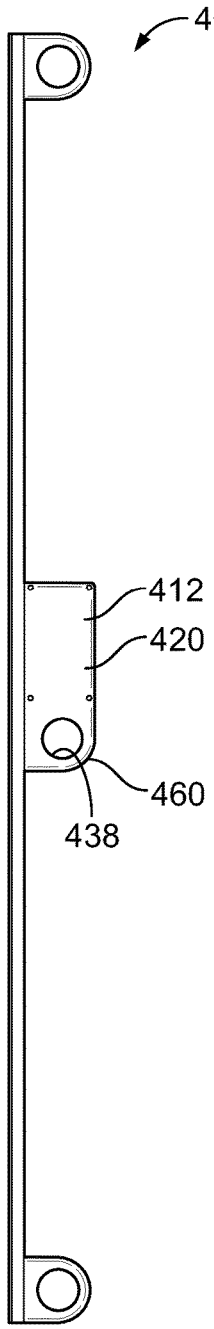
FIG. 4 illustrates a front perspective view of a product displaying holder system, according to an embodiment of the present disclosure.

FIG. 4 illustrates another example retaining bracket 400. In this example the retaining bracket 400 is identical to the retaining bracket 100 of FIG. 1, only the centrally located securing mount 412 is provided without a second section that extends past a first section of the flat panel 420 of the securing mount 412. In this example the flat panel 420 has a uniform width that includes an arcuate surface 460 adjacent the opening 438.

Figure 5:
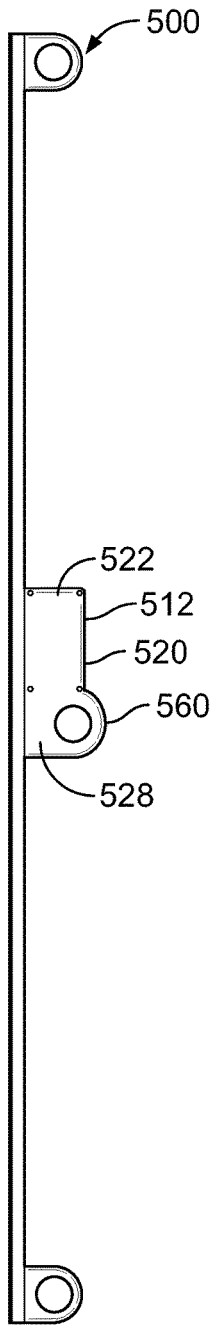
FIG. 5 illustrates a front perspective view of a product displaying holder system, according to an embodiment of the present disclosure.

FIG. 5 similarly illustrates another example retaining bracket 500. In this example the retaining bracket 500 is identical to the retaining brackets 100 of FIG. 1 and 400 of FIG. 4, only the centrally located securing mount 512 is provided with a second section 528 that extends past the first section 522 of the flat panel 520, but unlike the second section 128 of FIG. 1, only includes a single arcuate surface 560 without providing a planar surface. FIGS. 4 and 5 illustrate that different flat panels may be provided for individual retaining brackets.

Figure 6:
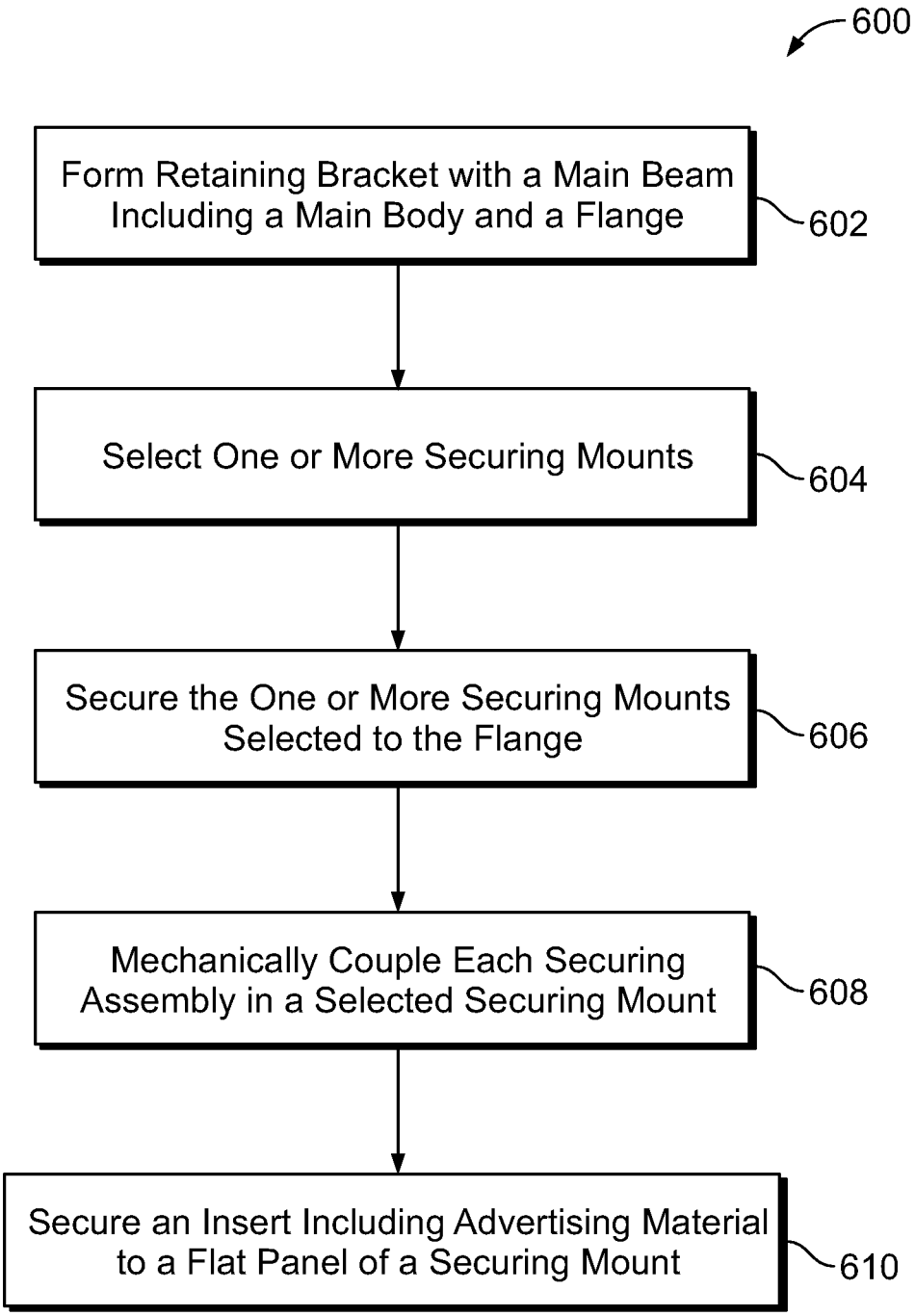
FIG. 6 illustrates a flow block diagram of a method of forming a product displaying holder system, according to an embodiment of the present disclosure.

FIG. 6 illustrates a method 600 of manufacturing a product displaying holder system. In example embodiments the product display holder system may be any of the product displaying holder systems described herein.

At 602, a retaining bracket is formed that has a main beam including a main body and a flange extending from the main body, the main body having a plurality of holder channels formed therethrough. The retaining bracket may be metal extruded, molded, mechanically machined, or the like to form the retaining bracket. In one example, the flange extends orthogonally from the main body.

At 604, one or more securing mounts is selected including at least one securing mount with a flat panel configured to receive and display advertising material. The securing mounts to be selected may include securing mounts that do not include a flat panel, and securing mounts with a flat panel. The flat panel may be of any size and shape that allows the receipt of an insert to display advertising materials. The flat panels include those as described in relations to FIGS. 1-5. In one example three securing mounts are selected with only one including a flat panel. In other examples five securing mounts are selected with each including a flat panel. In yet another example only two securing mounts are selected and neither includes a flat panel.

At 606, the one or more securing mounts selected are secured to the flange of the main beam. In one example the securing mounts are spot welded to the flange. In particular, the flange has the size and shape to facilitate welding the surface to each of the securing mounts. In this manner, different types of product displaying holder systems may be manufactured using the same process with the selection process being the only variable. This results in ease of manufacturing and saves on manufacturing costs.

At 608, the securing assembly is mechanically coupled in each of the one or more securing mounts selected. Each securing assembly is configured to securely couple the product displaying holder system to the surface of the component. In one example a suction cup assembly is provided as each securing assembly and secured within an opening in a corresponding securing mount.

At 610, an insert including the advertising material is secured to the flat panel. In one example, a pocket is secured to the flat panel that receives the insert. In yet another example the insert is adhered to the flat panel. Alternatively, the insert may be mechanically coupled to the flat panel including through use of fasteners such as a nut and bolt, snap or compression fit elements, static electricity, or the like.

Figure 7:
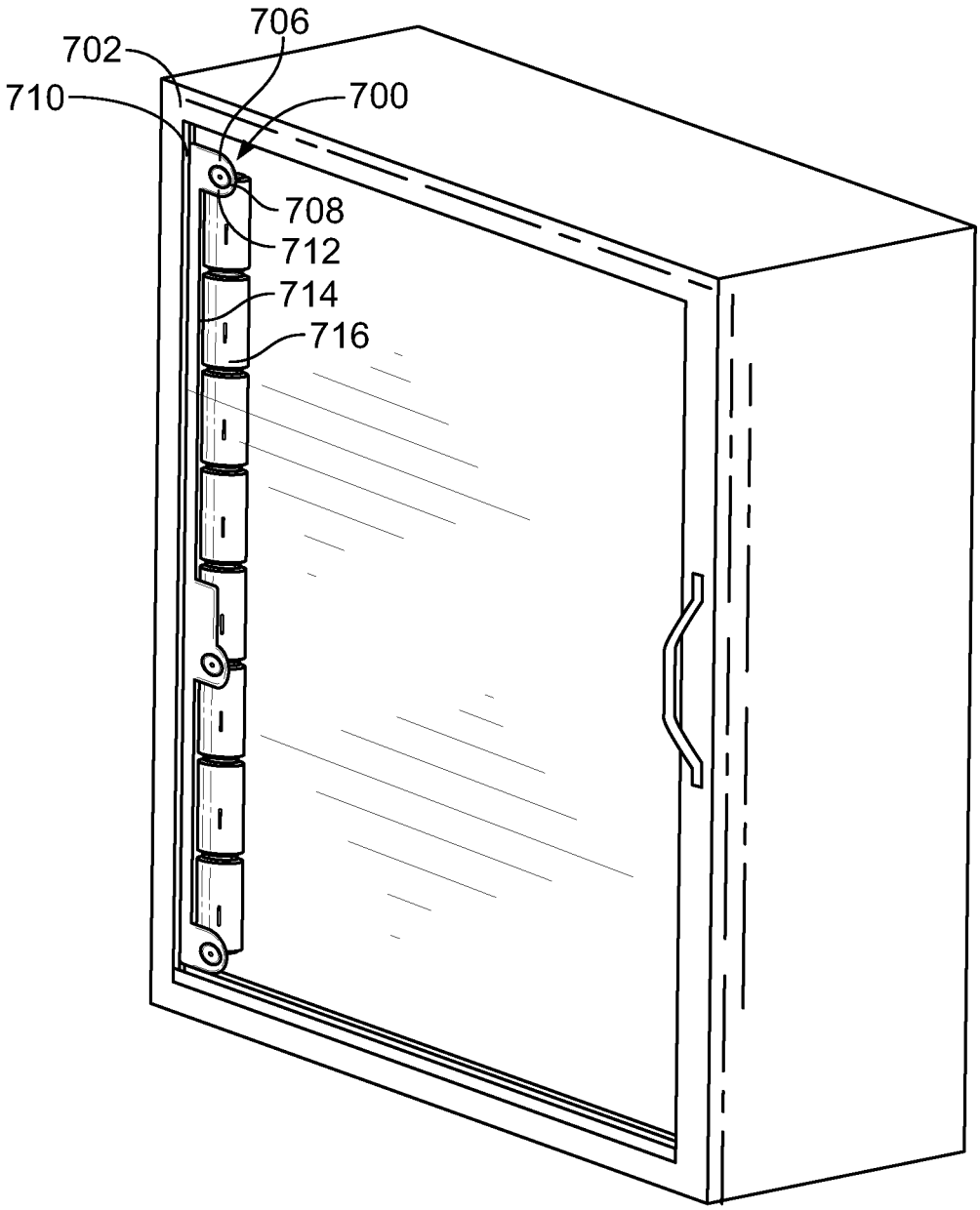
FIG. 7 illustrates a perspective front view of the product displaying holder system secured to a door, according to an embodiment of the present disclosure.
Figure 8:
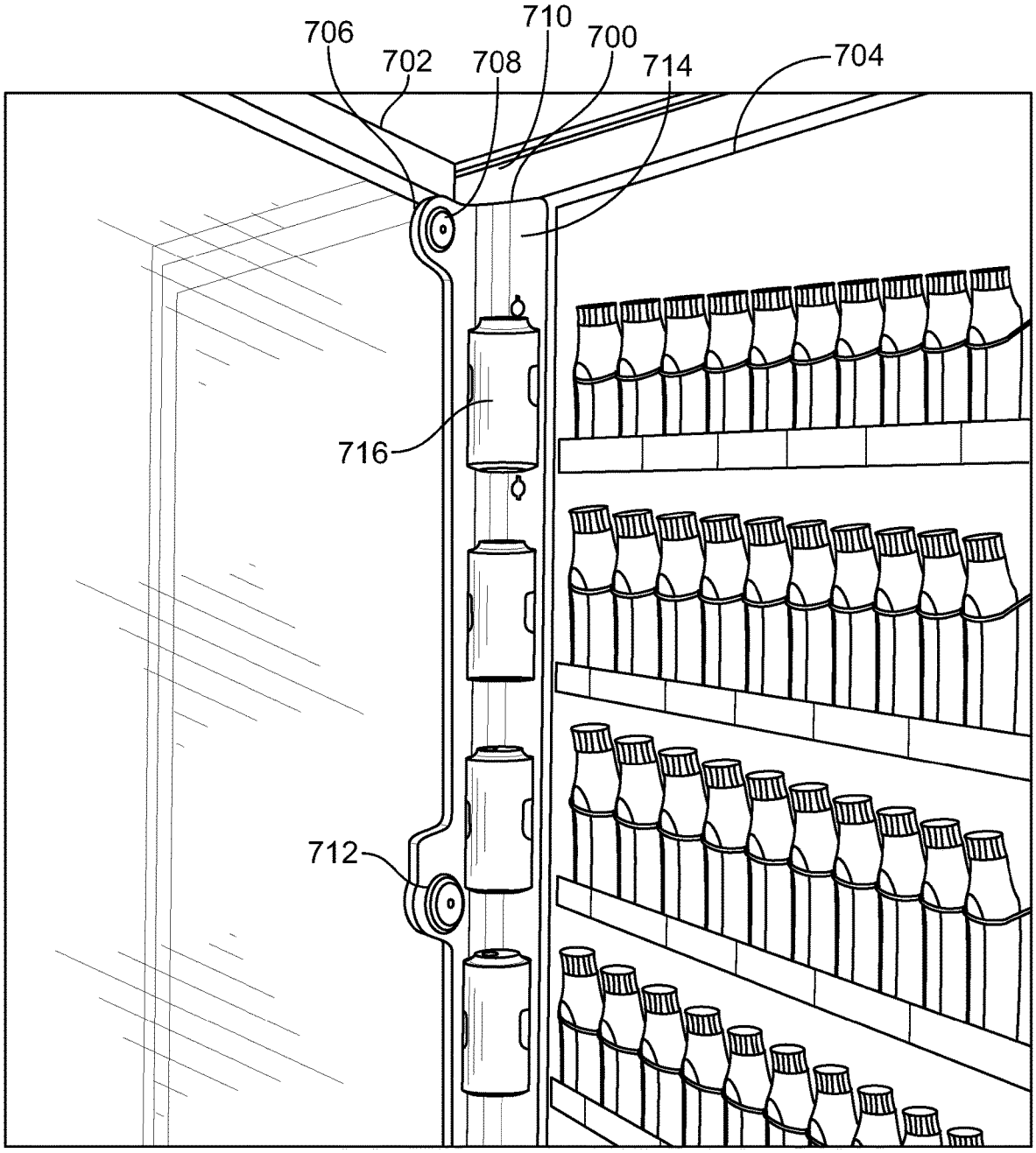
FIG. 8 illustrates views of the product displaying holder system secured to a door of a refrigerated compartment, according to an embodiment of the present disclosure.

FIG. 7 illustrates a perspective front view of the product displaying holder system 700 secured to a door 702, according to an embodiment of the present disclosure. The product displaying holder system 700 may be any product displaying holder system 100, 400, or 500 previously described. FIG. 8 illustrates views of the product displaying holder system 700 secured to the door 702 of a refrigerated compartment 704 (FIG. 8), according to an embodiment of the present disclosure. The suction cups 706 of the securing assemblies 708 secure the product displaying holder system 700 to an interior surface of a transparent portion (such as a glass panel) of the door 702. As shown, the product displaying holder system 700 may be positioned proximate to a hinge 710 of the door 702. The orthogonal relationship between the securing mounts 712 and the main beam 714 allows the main beam 714 to be positioned laterally away from the transparent surface of the door 702, thereby reducing the appearance of the main beam 714 in relation to the door 702. In this manner, the beverage containers 716 appear to be suspended and floating in relation to the door 702, as the main beam 714 is offset towards the hinge 710. The orthogonal relationship between the securing mounts 712 and the main beam 714 ensures that the main beam 714 does not interfere with presentation and display of the beverage containers 716.

Figure 9:
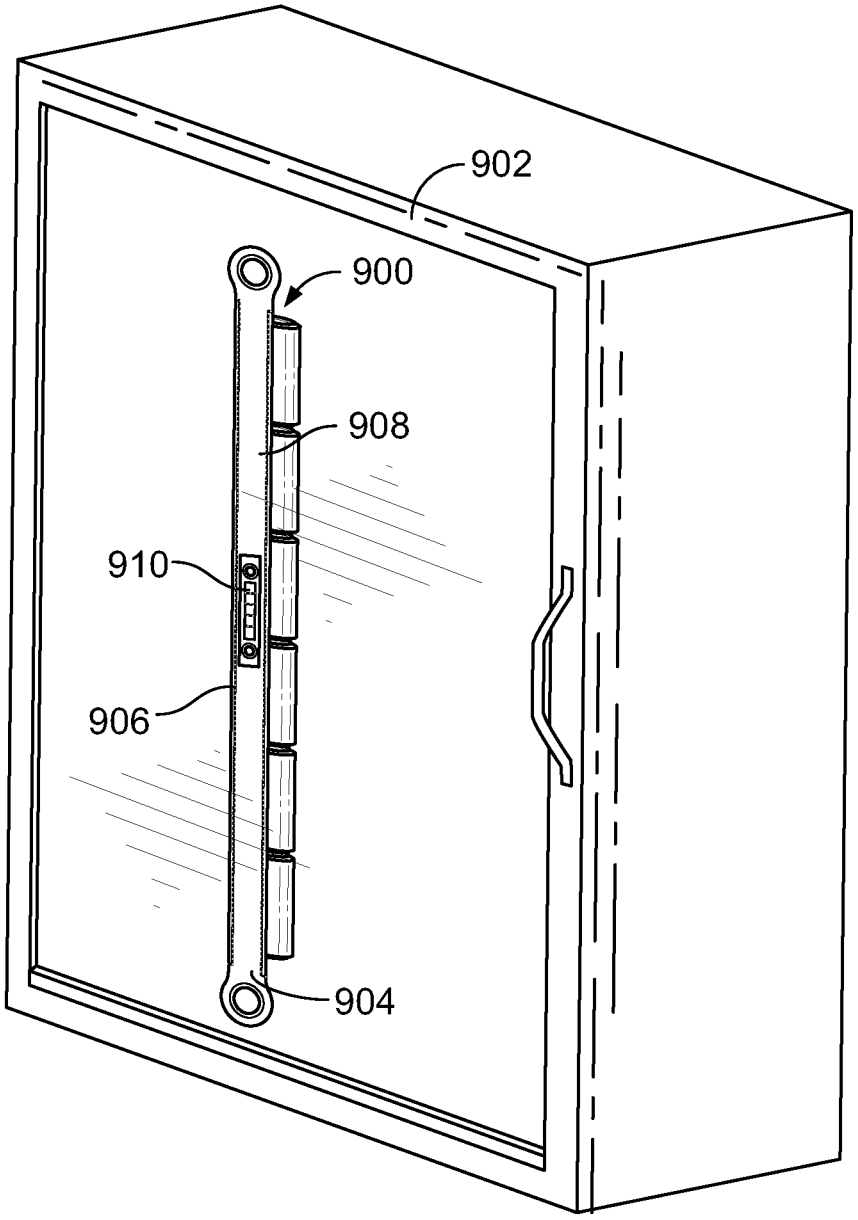
FIG. 9 illustrates views of the product displaying holder system secured to a door of a refrigerated compartment, according to an embodiment of the present disclosure.

FIG. 9 illustrates a perspective front view of the product displaying holder system 900 secured to a door 902, according to an embodiment of the present disclosure. The product displaying holder system 900 may be any product displaying holder system 100, 400, or 500 previously described. As shown, the main beam 904 may include lateral tracks 906 that define central recess 908 therebetween. The tracks 906 and the recess 908 are oriented toward the interior transparent surface of the door 902. An insert 910 may be positioned within the recess 908 and retained by the tracks 906. The insert 910 may include text and/or graphics, such as an advertisement for product.

Figure 10:
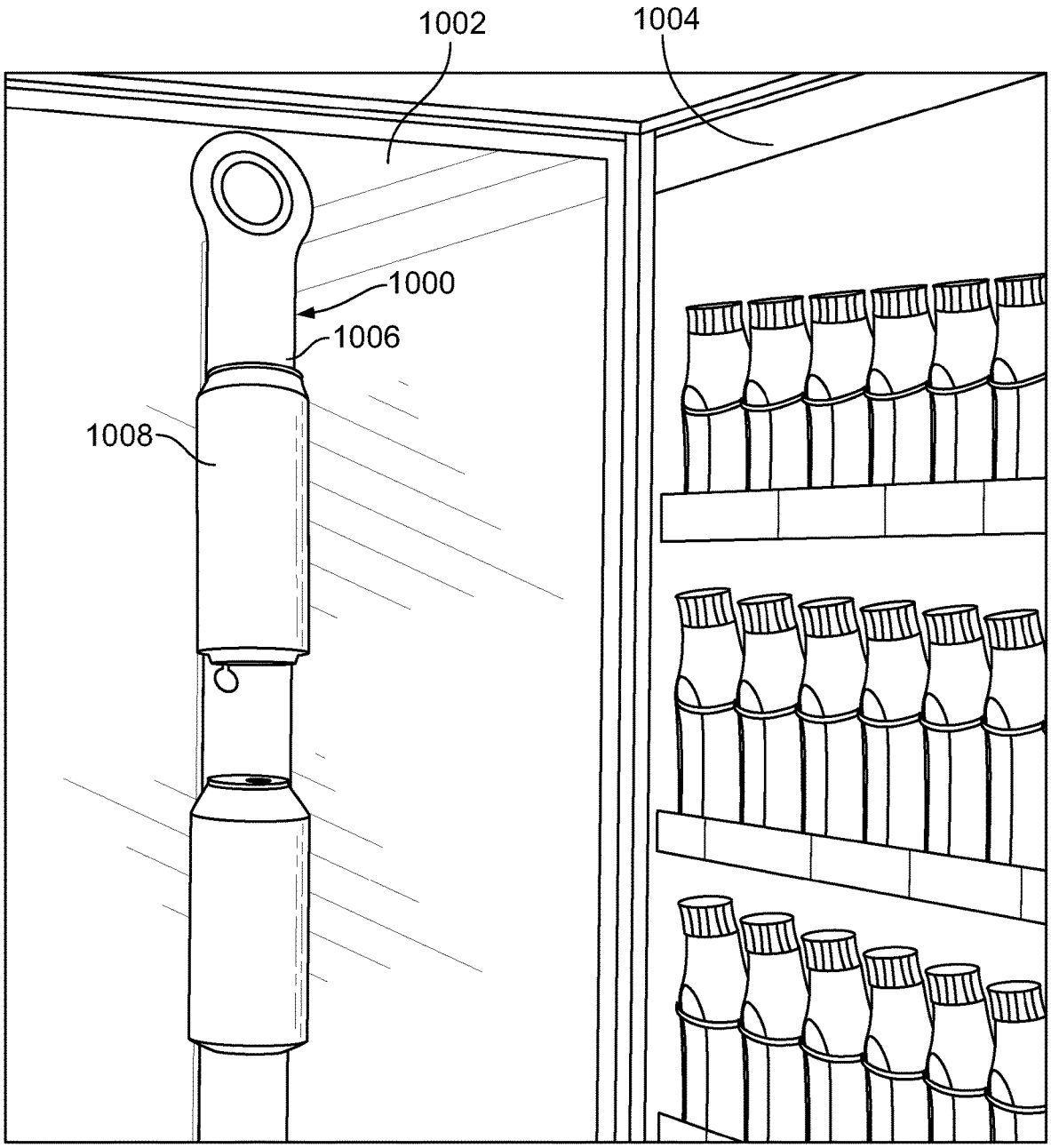
FIG. 10 illustrates a front exploded view of a product displaying holder system, according to an embodiment of the present disclosure.

FIG. 10 illustrates views of the product displaying holder system 1000 secured to the door 1002 of the refrigerated compartment 1004, according to an embodiment of the present disclosure. The product displaying holder system 1000 may be any product displaying holder system 100, 400, or 500 previously described. Unlike the embodiments shown and described with respect to FIGS. 7-9, when the product displaying holder system 1000 is secured to the door 1002, and the door 1002 is closed, the main beam 1006 may block a view of the beverage containers 1008. When the door 1002 is opened, an individual may readily view the beverage containers 1008.

Figure 11:
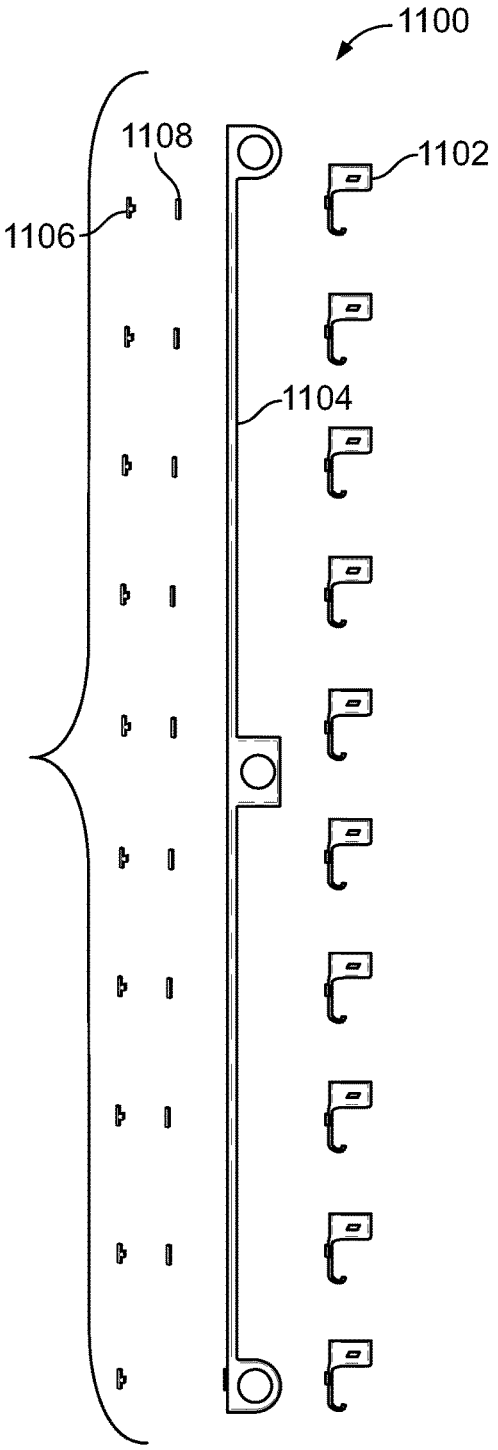
FIG. 11 illustrates a front exploded view of a product displaying holder system, according to an embodiment of the present disclosure.
Figure 12:
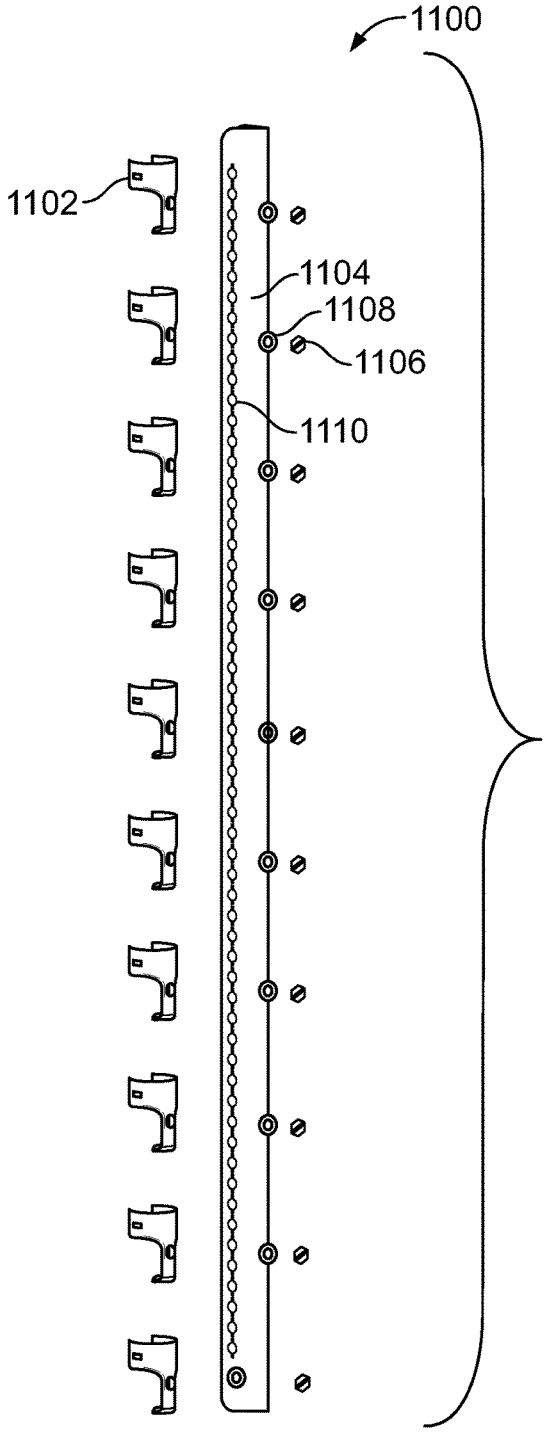
FIG. 12 illustrates a perspective rear exploded view of a product displaying holder system, according to an embodiment of the present disclosure.
Figure 13:
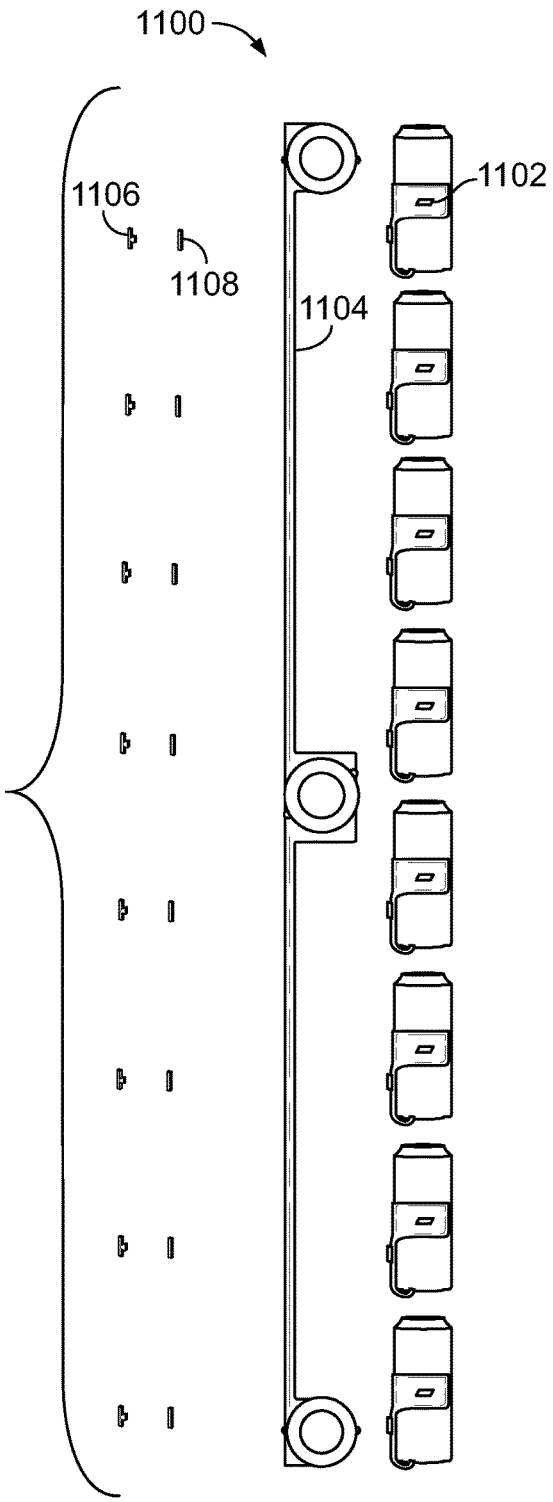
FIG. 13 illustrates a front exploded view of a product displaying holder system, according to an embodiment of the present disclosure.
Figure 14:
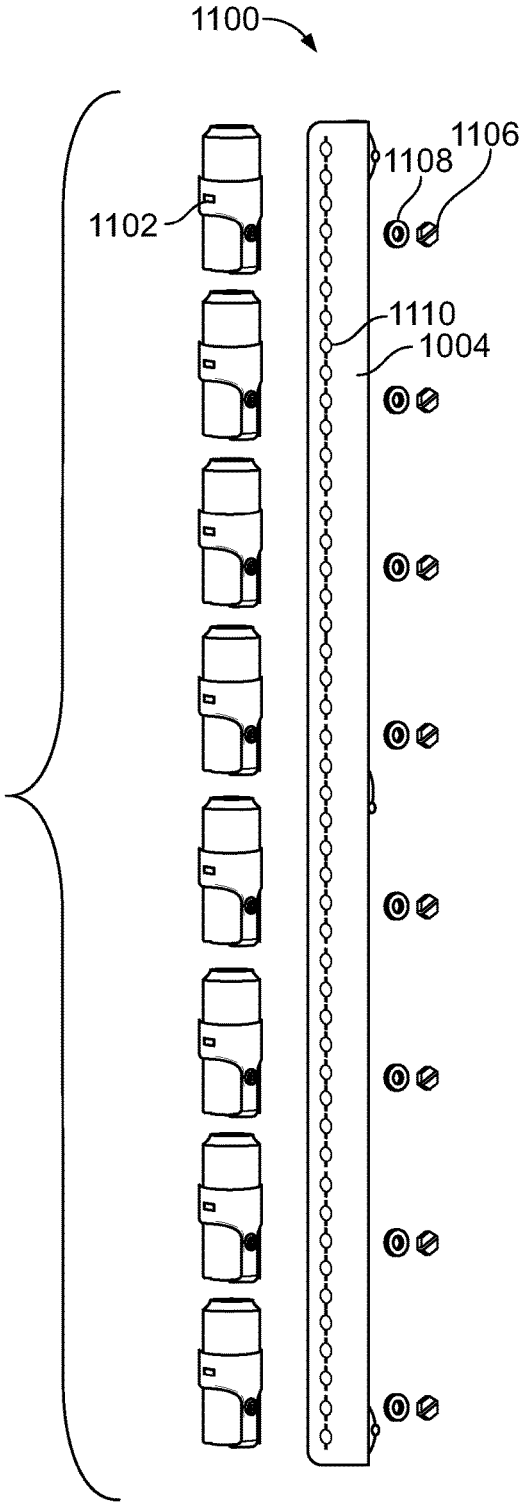
FIG. 14 illustrates a side exploded view of a product displaying holder system, according to an embodiment of the present disclosure.

FIG. 11 illustrates a front exploded view of a product displaying holder system 1100, according to an embodiment of the present disclosure. FIG. 12 illustrates a perspective rear exploded view of the product displaying holder system 1100. The product displaying holder system 1100 may be any product displaying holder system 100, 400, or 500 previously described. FIG. 13 illustrates a front exploded view of the product displaying holder system 1100. FIG. 14 illustrates a side exploded view of the product displaying holder system 1100.

Referring to FIGS. 11-14, the product holders 1102 may be secured to the main beam 1104 through fasteners 1106 and spacers 1108. The holder channels 1110 may have a keyhole shape. The fasteners 1106 and spacers 1108 cooperate with the keyhole holder channels 1110 to lock the product holders 1102 in place to prevent rotation. The spacers 1108 provide keyhole spacers that secure the product holders 1102 from the back (in conjunction with the fasteners 1106). The spacers 1108 close gaps that may be formed relative to the holder channels 1110 and allow the fasteners 1106 to have sufficient thread engagement to lock against the main beam 1104 and pull the product holders 1102 tight against the main beam 1104.

Referring to FIGS. 1-14, embodiments of the present disclosure provide product displaying holder systems that are configured to be secured to a surface of a component, such as a transparent surface of a door of a refrigerated compartment. The product displaying holder systems removably retain beverage containers within product holders. Embodiments of the present disclosure provide systems and methods of accommodating and displaying increased numbers of products within a display container, such as a refrigerated compartment. Additionally, a method is provided for reducing manufacturing complexities and reducing manufacturing cost.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. A product displaying holder system that is configured to be removably coupled to a surface of a component, the product displaying holder system comprising:

a retaining bracket having a main beam and a plurality of securing mounts, wherein the main beam includes an elongated vertical main body and an elongated vertical flange extending orthogonally from the main body, wherein the securing mounts extend from the flange, wherein a plurality of holder channels are formed through the main body;

one or more product holders removably coupled to the retaining bracket, each product holder is configured to hold a beverage can therein respectively, each of the one or more product holders including a bracket-mating stud that is retained within one of the plurality of holder channels, wherein the plurality of holder channels allow the one or more product holders to be selectively positioned at different locations along the main body; and securing assemblies coupled to the securing mounts, wherein the securing assemblies are configured to securely couple the product displaying holder system to the surface of the component.

2. The product displaying holder system of claim 1, wherein the plurality of holder channels are longitudinally aligned along a common longitudinal axis.

3. The product displaying holder system of claim 1, wherein the securing mounts are perpendicular to the main beam.

4. The product displaying holder system of claim 1, wherein the securing mounts comprise at least three securing mounts.

5. The product displaying holder system of claim 1, wherein each of the securing assemblies comprises a suction cup coupled to a suction securing nut.

6. The product displaying holder system of claim 1, wherein the main beam is configured to be positioned proximate to a hinge of a door.

7. The product displaying holder system of claim 1, further comprising an insert having one or more of text or graphics removably coupled to the main beam.

8. A product displaying holder system that is configured to be removably coupled to a surface of a component, the product displaying holder system comprising:

a retaining bracket having a main beam including an elongated vertical main body and an elongated vertical flange extending orthogonally from the main body, the main body having a plurality of holder channels formed therethrough;

at least one product holder including a bracket-mating stud that is removably coupled to a corresponding holder channel of the main body, each product holder is configured to hold a beverage can therein respectively, a plurality of securing mounts secured directly to the flange of the main beam;

at least one of the securing mounts including a flat panel configured to receive and display advertising material; and securing assemblies coupled to the securing mounts, wherein the securing assemblies are configured to securely couple the product displaying holder system to the surface of the component.

9. The product displaying holder system of claim 8, wherein each flat panel extends from a first end to a second end that includes an opening for receiving a corresponding securing assembly of the securing assemblies.

10. The product displaying holder system of claim 9, wherein each flat panel includes a first section at each first end respectively and a second section that includes a corresponding opening for receiving each corresponding securing assembly respectively, and each second section extends past each first section respectively.

11. The product displaying holder system of claim 10, wherein each second section includes at least on arcuate surface.

12. The product displaying holder system of claim 9, wherein each flat panel includes a uniform width.

13. The product displaying holder system of claim 8, wherein the securing mounts are spot welded to the flange of the main beam.

14. The product displaying holder system of claim 8, wherein the securing mounts are perpendicular to the main body of the main beam.

15. The product displaying holder system of claim 8, wherein each of the securing assemblies comprises a suction cup coupled to a suction securing nut.

16. The product displaying holder system of claim 8, wherein the main beam is configured to be positioned proximate to a hinge of a door.

17. The product displaying holder system of claim 8, further comprising an insert having one or more of text or graphics removably coupled to the main beam.

18. A method of manufacturing a product displaying holder system comprising the steps of:

providing a retaining bracket having a main beam including an elongated vertical main body and an elongated vertical flange extending orthogonally from the main body, a plurality of holder channels formed through the main body, and a plurality of securing mounts extending from the flange, at least one of the securing mounts includes a flat panel configured to receive and display advertising material;

removably coupling one or more product holders to the retaining bracket, each product holder is configured to hold a beverage can therein respectively, each of the one or more product holders including a bracket-mating stud that is retained within one of the plurality of holder channels, wherein the plurality of holder channels allow the one or more product holders to be selectively positioned at different locations along the main body; and coupling securing assemblies to the securing mounts, the securing assemblies are configured to securely couple the product displaying holder system to a surface of a component.

19. The method of claim 18, further comprising the step of: welding each of the securing mounts to the flange.

20. The method of claim 18, further comprising the steps of: securing an insert including the advertising material to the flat panel.

* * * * *